US007069921B1

(12) United States Patent
Kolak et al.

(10) Patent No.: US 7,069,921 B1
(45) Date of Patent: Jul. 4, 2006

(54) CONTROL CIRCUIT FOR CAPACITOR DISCHARGE IGNITION SYSTEM

(75) Inventors: Lewis M. Kolak, Reese, MI (US); Gerald J. LaMarr, Jr., Bay City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 11/054,238

(22) Filed: Feb. 9, 2005

(51) Int. Cl.
*F02P 1/00* (2006.01)

(52) U.S. Cl. ..... 123/599; 123/648

(58) Field of Classification Search ..... 123/594, 123/596, 599, 605, 618, 648, 655; 324/380, 324/382, 378
See application file for complete search history.

(56) References Cited

U.S. PATENT DOCUMENTS 4,155,341 A * 5/1979 Fernquist et al. ..... 123/406.57
4,244,337 A * 1/1981 Asai ..... 123/603
5,245,965 A 9/1993 Andersson
5,992,401 A * 11/1999 Bylsma et al. ..... 123/596
6,388,445 B1 * 5/2002 Andersson ..... 324/380
6,408,820 B1 * 6/2002 LaMarr, Jr. ..... 123/406.57
6,932,064 B1 * 8/2005 Kolak et al. ..... 123/605

* cited by examiner

*Primary Examiner*—Mahmoud Gimie
(74) *Attorney, Agent, or Firm*—Reising, Ethington, Barnes, Kisselle, P.C.

(57) ABSTRACT

A capacitor discharge ignition (CDI) system for a light-duty spark ignition combustion engine includes an analog control circuit having a charging circuit, a trigger circuit and a shutdown circuit. In response to activation of a kill-switch, the shutdown circuit causes a switching device to discharge an ignition capacitor. Through the use of an RC circuit, the switching device continues to be biased such that it prolongs the discharge of the ignition capacitor, thereby preventing it from storing charge for the upcoming ignition pulse. This generally continues until the engine has come to a stop, at which time the engine can be immediately restarted without having to reset anything. The control circuit may also include engine speed limiting and ignition timing features.

25 Claims, 3 Drawing Sheets

CONTROL CIRCUIT FOR CAPACITOR DISCHARGE IGNITION SYSTEM

FIELD OF THE INVENTION

The present invention generally relates to an ignition system for use with an internal combustion engine, and more particularly, to a capacitor discharge ignition system having a control circuit.

BACKGROUND OF THE INVENTION

Capacitor discharge ignition (CDI) systems are widely used with internal combustion engines, especially light duty combustion engines employed by hand-held tools. In addition to a number of other components, a CDI system typically has some type of kill-switch that allows an operator to shut the engine down when it is running. Kill-switches can include, but are not limited to, on/off switches, momentary switches, and positive off/automatic on type switches.

On/off switches generally require an operator to move the switch to a desired state before the engine can operate in that state. For instance, if an engine is running and the operator wishes to turn it off, then the operator must move the on/off switch to the 'off' position. Before the operator can turn the engine on again, the on/off switch must be moved to the 'on' position; thus, turning the engine off and on requires a minimum of two activations of the on/off switch.

Momentary switches, on the other hand, require an operator to hold down the switch while the engine shuts down; if the switch is not engaged for the requisite amount of time, then it is possible for the engine to resume operation when the operator disengages it. Unlike on/off switches, momentary switches do not require the switch to be reset back to some 'on' position before the engine can be restarted.

Positive off/automatic on switches allow an operator to shut the engine down simply by pressing the switch for a brief moment, after which the switch automatically resets such that the engine can be restarted without further switch activation. As previously stated, the aforementioned kill-switch types are only examples of some of the different switch types that can be used by CDI systems, as others also exist.

SUMMARY OF THE INVENTION

According to one aspect of the invention, there is provided a control circuit for use with an ignition system that includes a charging circuit, a timing circuit and a shutdown circuit. A shutdown signal is generated by activation of a kill-switch and causes a second switching device to discharge a shutdown capacitor, which in turn biases a first switching device such that it continues to discharge the ignition capacitor.

According to another aspect of the invention, there is provided a control circuit that includes a timing circuit and a shutdown circuit. Activation of a kill-switch causes: (i) a second switching device to discharge a shutdown capacitor, (ii) the discharged shutdown capacitor to activate a first switching device, (iii) the activated first switching device to discharge an ignition capacitor, and (iv) an RC circuit to prolong the activation of the first switching device.

There is also provided a capacitor discharge ignition system and a shutdown method for use with a combustion engine.

Some objects, features and advantages of this invention include, but are not limited to, providing a control circuit that quickly shuts down an engine in response to the activation of a kill-switch, providing a control circuit that effectively controls the creation and distribution of ignition pulses, providing a control circuit that includes speed limiting and ignition timing features, and providing a control circuit that is of a design that is relatively simple and economical to manufacture, and in service has a significantly increased useful life.

BRIEF DESCRIPTION OF THE DRAWINGS

These and other objects, features and advantages of the present invention will be apparent from the following detailed description of the preferred embodiments and best mode, appended claims and accompanying drawings, in which:

DETAILED DESCRIPTION

Referring to the figures, there is shown a capacitive discharge ignition (CDI) system 10 for use with an internal combustion engine. CDI system 10 can be used with one of a number of types of internal combustion engines, but is particularly well suited for use with light-duty combustion engines. The term 'light-duty combustion engine' broadly includes all types of non-automotive combustion engines, including two- and four-stroke engines used with hand-held power tools, lawn and garden equipment, lawnmowers, weed trimmers, edgers, chain saws, snowblowers, personal watercraft, boats, snowmobiles, motorcycles, all-terrain-vehicles, etc. As will be explained in greater detail, CDI system 10 can include one of a number of control circuits, including the various embodiments shown in FIGS. 2–5.

Figure 1:
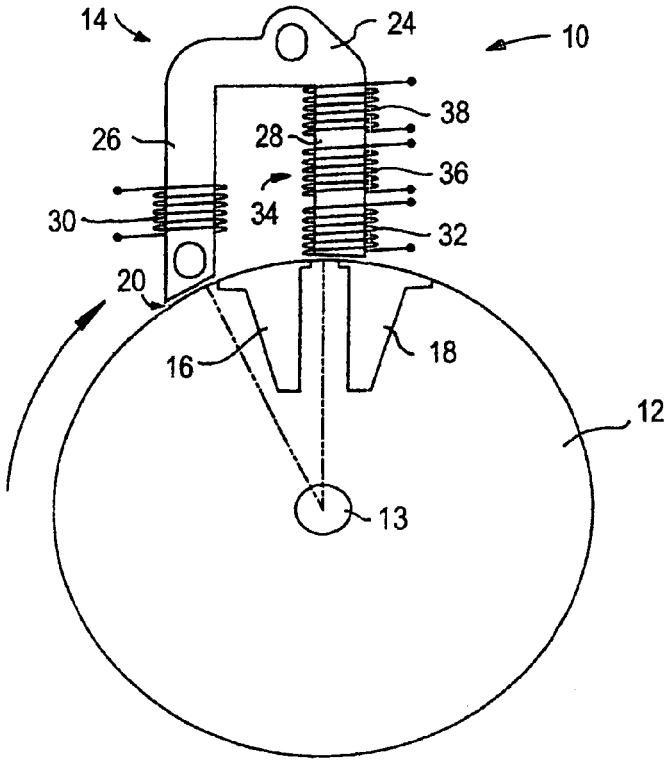
FIG. 1 shows a capacitor discharge ignition (CDI) system generally having a stator assembly mounted adjacent a rotating flywheel.

With reference to FIG. 1, CDI system 10 generally includes a flywheel 12 rotatably mounted on an engine crankshaft 13, a stator assembly 14 mounted adjacent the flywheel, and a control circuit (not shown in FIG. 1). Flywheel 12 rotates with the engine crankshaft such that it induces a magnetic flux in the nearby stator assembly 14, and generally includes a permanent magnetic element having pole shoes 16, 18.

Stator assembly 14 is separated from the rotating flywheel by a measured air gap 20 that is approximately 0.3 mm, and generally includes a lambstack 24 having first and second legs 26, 28, a charge coil 30, a trigger coil 32 and an ignition coil 34 having primary and secondary windings 36, 38. Lambstack 24 is a generally U-shaped ferrous armature made from a stack of laminated iron plates, and is preferably mounted to a housing (not shown) located on the engine. Preferably, charge coil 30 is wound around first leg 26 and trigger coil 32 is wound around second leg 28 such that a phase separation occurs between the charge and trigger coils of about 10° to 50°, but is preferably about 25°. Ignition coil 34 is a step-up transformer having both the primary and secondary windings 36, 38 wound around second leg 28 of the lambstack. Primary winding 36 is coupled to the control circuit, as will be explained, and the secondary winding 38 is coupled to a spark plug 40 (not shown in FIG. 1). As is appreciated by those skilled in the art, primary winding 36 has comparatively few turns of relatively heavy wire, while secondary winding 38 has many turns of relatively fine wire. The ratio of turns between primary and secondary windings 36, 38 generates a high voltage potential in the secondary winding that is used to fire spark plug 40 or provide an electric arc and consequently ignite an air/fuel mixture in the combustion chamber.

The control circuit is coupled to stator assembly 14 and spark plug 40 and generally controls the energy that is induced, stored and discharged by CDI system 10. The term "coupled" broadly encompass all ways in which two or more electrical components, devices, circuits, etc. can be in electrical communication with one another; this includes but is certainly not limited to, a direct electrical connection and a connection via an intermediate component, device, circuit, etc. The control circuit can be provided according to one of a number of embodiments, including the exemplary embodiments shown in FIGS. 2–5.

Figure 2:
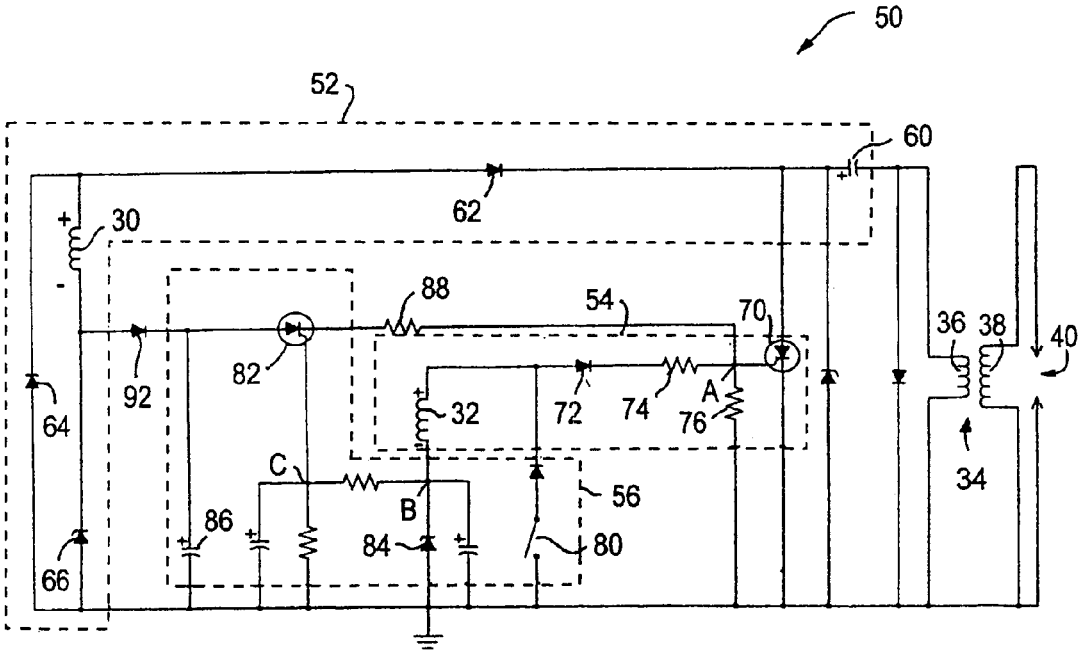
FIG. 2 is a schematic diagram of an embodiment of a control circuit that can be used with the CDI system of FIG. 1.

Turning now to FIG. 2, there is shown an embodiment of an analog control circuit 50 for controlling the energy that is induced, stored and discharged in the form of ignition pulses. Control circuit 50 is coupled to the various coils of CDI system 10, and generally includes a charging circuit 52, a timing circuit 54, and a shutdown circuit 56.

Charging circuit 52 generates and stores the energy for the ignition pulses that are eventually sent to spark plug 40, and generally includes charge coil 30, ignition capacitor 60, first diode 62, and additional diodes 64 and 66. As previously explained, charge coil 30 is carried on the first leg 26 of the lambstack 24 and preferably has an inductance of about 380 mH. The majority of the energy induced in charge coil 30 is dumped onto ignition capacitor 60, which stores the induced energy until the timing circuit 54 instructs it to discharge and preferably has a capacitance of about 0.47 μF. According to the embodiment shown here, a positive terminal of charge coil 30 is connected to first diode 62, which in turn is connected to ignition capacitor 60. Diode 64 is generally connected in parallel to the combination of charge coil 30 and diode 66.

Timing circuit 54 generates a trigger signal that discharges ignition capacitor 60 at the appropriate time, thereby creating a corresponding ignition pulse that is sent to spark plug 40. The timing circuit generally includes trigger coil 32, a first switching device 70, a diode 72, and resistors 74 and 76. As mentioned before, trigger coil 32 is preferably carried on the second leg 28 of lambstack 24 and according to a preferred embodiment has an inductance of about 12 mH. Trigger coil 32 periodically sends a trigger signal to first switching device 70, which is preferably a silicon controlled rectifier (SCR) type switch but could be any appropriate switching device known to those skilled in the art. As shown in the schematic, switching device 70 is wired such that when it is 'on', a conductive discharge path is created between ignition capacitor 60 and ground.

Shutdown circuit 56 generates a shutdown signal for shutting down the engine in response to kill-switch activation, and generally includes a kill-switch 80, a second switching device 82, a zener diode 84, a shutdown capacitor 86, and a number of other electrical components such as resistors, capacitors, etc. Kill-switch 80 is preferably an operator-controlled, momentary switch having a positive off/automatic on feature. However, it could be another switch type known to those skilled in the art. Like the first switching device, second switching device 82 also is preferably an SCR type switch and is coupled to first switching device 70, kill-switch 80, and shutdown capacitor 86. When second switching device 82 is 'on', shutdown capacitor 86 and resistors 88 and 76 form a resistor-capacitor (RC) circuit that can bias and control the state of first switching device 70. Additional capacitors and resistors shown in shutdown circuit 56 provide filtering, signal enhancement, and other functions appreciated by those skilled in the art.

During operation, rotation of flywheel 12 causes the magnetic elements to induce a voltage in charge coil 30 which charges both ignition capacitor 60 and shutdown capacitor 86. Ignition capacitor 60 is charged by energy flowing from the positive terminal of charge coil 30, as well as excess negative energy left over from charging shutdown capacitor 86. As shown in FIG. 2, additional diode 64 is generally connected in parallel with charge coil 30 and zener diode 66. When the voltage on the negative terminal of charge coil 30 exceeds the breakdown voltage of zener diode 66, then diode 64 allows negative energy provided by the charge coil negative terminal to flow back to charge coil 30. Shutdown capacitor 86 is coupled to the negative terminal of charge coil 30 by a diode 92 which half-wave rectifies the negative energy induced in the charge coil such that it flows to and is stored on shutdown capacitor 86. Once ignition capacitor 60 is charged, it awaits a trigger signal from timing circuit 54 so that it can discharge and thereby create a corresponding ignition pulse in ignition coil 34.

To discharge ignition capacitor 60, timing circuit 54 provides a trigger signal that creates a discharge path for the energy stored on the ignition capacitor. Each rotation of flywheel 12 causes the magnetic elements thereon to create a magnetic flux in trigger coil 32, which in turn causes the trigger coil to generate the trigger signal. The mechanical separation of charge coil 30 and trigger coil 32 on the legs of lambstack 24 ensures that the trigger signal is generated at a calculated time after the charge coil generates its positive energy. The trigger signal is half-wave rectified by diode 72 and affects the voltage at a node A, which has the same voltage as the gate of first switching device 70. When the node A voltage exceeds a predetermined level, first switching device 70 is turned 'on' (in this case, becomes conductive) to provide a discharge path for the energy stored on ignition capacitor 60. This rapid discharge of the ignition capacitor causes a surge in current through the primary winding 36 of the ignition coil 34, which in turn creates a collapsing electro-magnetic field in the ignition coil. The collapsing electro-magnetic field induces a high voltage ignition pulse in secondary winding 38, commonly referred to as 'flyback'. The ignition pulse travels to spark plug 40 which, assuming it has the requisite voltage, provides a combustion-initiating spark. This process continues until shutdown circuit 56 generates a shutdown signal, usually in response to activation of kill-switch 80.

Shutdown circuit 56 generates a shutdown signal in response to activation of kill-switch 80, but could be designed to be activated by other events such as a signal from a microprocessor. Activation of kill-switch 80 creates an electrical path for the shutdown signal through trigger coil 32 and kill-switch 80. When the kill-switch is closed and the voltage at a node B exceeds the breakdown voltage of zener diode 84, some current flows from the negative terminal of trigger coil 32, through zener diode 84, through kill-switch 80 and back to the positive terminal of the trigger coil. The current flowing through zener diode 84 causes the zener diode to determine the voltage level at node B, which in turn affects the voltage at node C that controls the state of second switching device 82. When second switching device 82 is turned on, shutdown capacitor 86 discharges via an electrical path that includes second switching device 82; this in turn affects the voltage at node A which controls the state of first switching device 70. Activation of first switching device 70 causes ignition capacitor 60 to discharge whatever charge it currently has stored. Instead of ignition capacitor 60 beginning to recharge, first switching device 70 continues to be biased 'on' which keeps the discharge path operating. Because no charge is allowed to accumulate on ignition capacitor 60 (as it is being discharged via first switching device 70), the engine slows down and comes to a stop. This all occurs so long as shutdown capacitor 86 continues to discharge and bias first switching device 70 in the 'on' position.

Preferably, second switching device 82 has a holding characteristic that keeps it active so long as current flows to it. The time constant of a resistor-capacitor (RC) circuit, which includes shutdown capacitor 86 and resistors 88 and 76, keeps current flowing to second switching device 82 in between rotations of flywheel 12 and thus prolongs the activation of the second switching device. As previously explained, each rotation of the flywheel causes a certain amount of energy to be stored on shutdown capacitor 86. Charging the shutdown capacitor allows it to continue to discharge through second switching device 82 until the next flywheel rotation. Therefore, the combination of the RC circuit and charge coil 30 keeps the second switching device 82, and hence the first switching device 70, biased in an 'on' state until the flywheel 12 comes to a stop. The prolonged activation of both switching devices 70, 82 maintains a short circuit for the charge flowing to ignition capacitor 60, and thus prevents the ignition capacitor from charging and discharging. Without a discharge of ignition capacitor 60, no spark can occur to fire the engine. As soon as the engine comes to a stop and any stored energy has been dissipated, electrical current ceases flowing to second switching device 82 such that it is switched to its off-state. Subsequently, an operator may restart the engine without delay.

Figure 3:
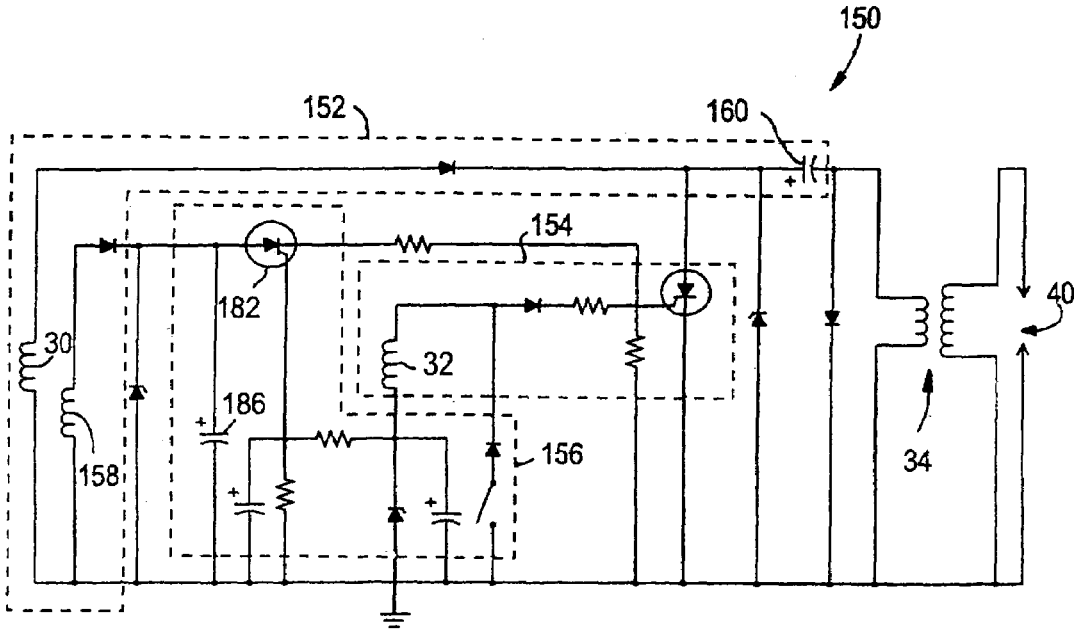
FIG. 3 is a schematic diagram of another embodiment of the control circuit of FIG. 2.

According to another embodiment shown in FIG. 3, analog control circuit 150 generally includes a charging circuit 152, a timing circuit 154 and a shutdown circuit 156, and is largely the same as that shown in FIG. 2. One difference is that an additional charge coil 158 has been added to charging circuit 152, and is coupled to second switching device 182 and shutdown capacitor 186. Charge coil 158 charges shutdown capacitor 186, thereby allowing charge coil 30 to use all of its energy to charge ignition capacitor 160. Thus, charge coil 30 is able to provide more energy to ignition capacitor 160, which in turn can deliver higher energy ignition pulses. This is particularly useful for systems that require more power, such as engines that run at higher RPMs. Preferably, the additional charge coil 158 is wound on the first leg 26 of the lambstack and is 180° out of phase with charge coil 30; this reduces the peak load on the magnetic circuit and thereby maximizes the magnetic energy of the system. Timing circuit 154 and shutdown circuit 156 are largely the same as those circuits 54 and 56 of FIG. 2 bearing the same name, thus a duplicate discussion of their structure and function has been omitted.

Figure 4:
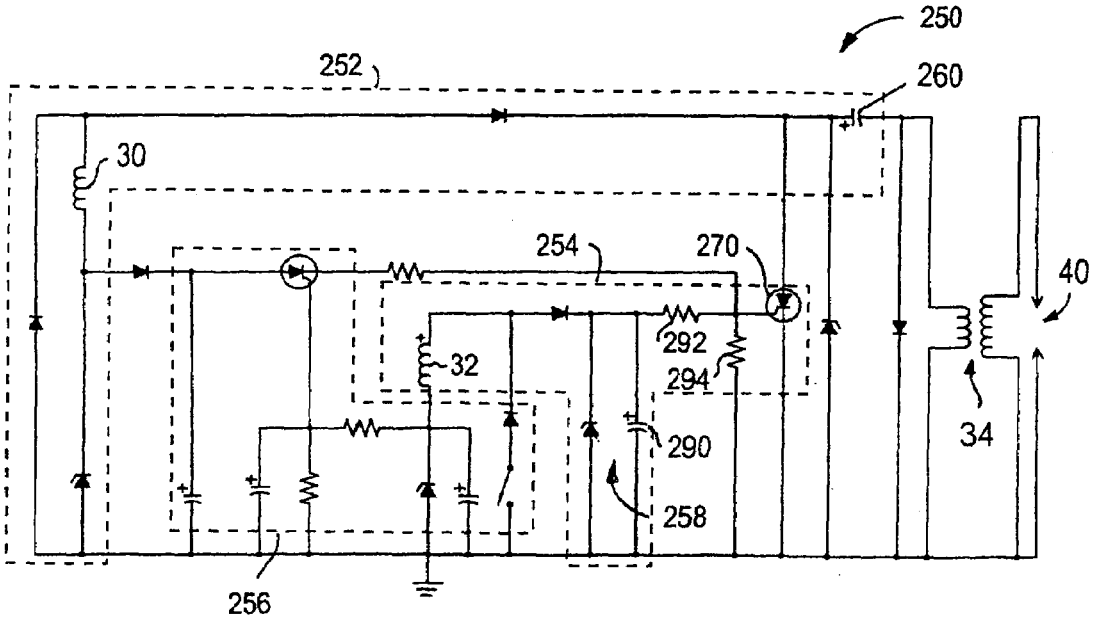
FIG. 4 is a schematic diagram of another embodiment of the control circuit of FIG. 2.

With reference to FIG. 4, there is shown another embodiment of an analog control circuit 250 which is generally the same as the previous embodiments and includes a charging circuit 252, a timing circuit 254 and a shutdown circuit 256. According to this embodiment, timing circuit 254 further includes a speed limiting feature 258 having a speed limiting capacitor 290 coupled to resistors 292 and 294 to form a resistor-capacitor (RC) circuit. The speed limiting capacitor 290 is generally wired such that trigger coil 32 charges the speed limiting capacitor 290 each time a trigger signal is generated. Speed limiting capacitor 290 is also coupled to the gate of first switching device 270.

In operation, so long as the engine speed remains below a predetermined threshold, the speed limiting capacitor 290 has sufficient time to discharge through the resistor-capacitor (RC) circuit before trigger coil 32 generates the next trigger signal. As appreciated by those skilled in the art, the time constant of the RC circuit sets the predetermined time needed for discharge of speed limiting capacitor 290. Thus, control circuit 250 operates in its normal state when the engine speed remains below a predetermined threshold speed. But if the engine speed exceeds the predetermined threshold speed, then speed limiting capacitor 290 will not have fully discharged by the time the next trigger signal is generated. In this case, first switching device 270 will remain 'on' after the trigger signal has been sent and until the speed limiting capacitor 290 is discharged, which has the effect of preventing ignition capacitor 260 from charging. Accordingly, one or more ignition pulses will be skipped which decreases the speed of the engine until it resumes a speed below the threshold level. Further discussion on speed limiting is included in U.S. Pat. No. 5,245,965, which is assigned to the assignee hereof and is incorporated herein by reference.

Figure 5:
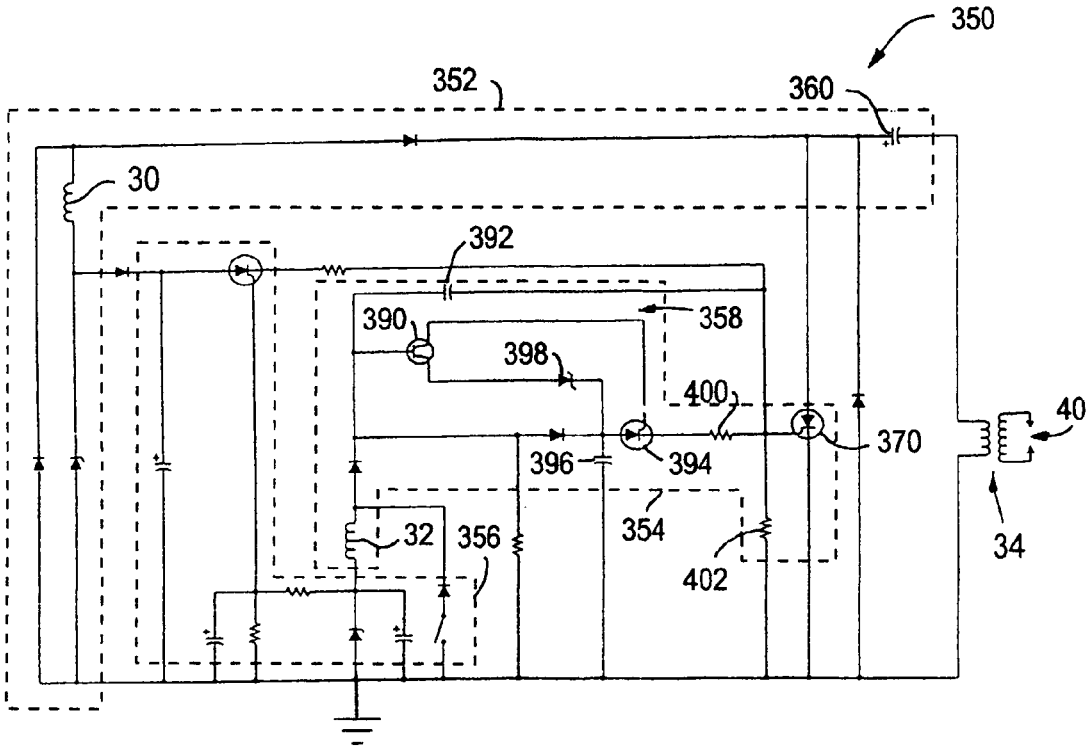
FIG. 5 is a schematic diagram of yet another embodiment of the control circuit of FIG. 2.

Referring to FIG. 5, there is shown an embodiment of an analog control circuit 350 that is generally the same as those previously disclosed, but includes an ignition timing feature 358. Control circuit 350 generally includes charging circuit 352, timing circuit 354 and shutdown circuit 356, and can change the ignition timing depending upon the engine speed. Timing circuit 354 has an ignition timing feature 358 which preferably includes a voltage comparator 390 coupled to trigger coil 32, a capacitor 392 and a timing switch 394. The voltage comparator 390 is preferably a transistor, such as a PNP transistor, and has a collector terminal connected to the gate of the timing switch 394 to control its activation. Timing switch 394 is in turn coupled to trigger coil 32, first switching device 370 and timing capacitor 396. As seen in the figure, additional diodes, resistors, etc. can also be used.

During operation at low engine speeds (about 0–4,000 RPM), ignition timing feature 358 controls the ignition timing such that spark plug 40 fires at approximately 10° BTDC. Each pulse induced in trigger coil 32 is half-wave rectified and charges capacitors 392 and 396 (capacitor 392 has a very small capacitance so that it charges very quickly). After the half-wave rectified pulse reaches its peak and begins to come down, the voltage stored on timing capacitor 396 becomes greater than the voltage seen at the base of voltage comparator or transistor 390, even when taking the zener diode 398 into account, thereby turning on comparator 390. For example, if zener diode 398 has a breakdown voltage of 5v and a voltage drop of 0.7v is required to turn on comparator 390, then comparator 390 will turn on when the voltage drop between timing capacitor 396 and the base of comparator 390 exceeds 5.7v. Activation of voltage comparator 390 creates a path so that the stored charge on timing capacitor 396 can turn on timing switch 394. Once the timing switch is activated, timing capacitor 396 discharges its stored charge through a resistor-capacitor (RC) circuit formed with resistors 400 and 402, which conveniently activates first switching device 370. The time constant created by this RC circuit determines the discharge rate of timing capacitor 396, which in turn determines the duration during which first switching device 370 is activated. The process explained above causes a delay between the time that a trigger pulse is induced in trigger coil 32 and the time when first switching device 370 is activated; this timing delay results in an ignition timing of approximately 10° BTDC, which is a timing retard compared to the ignition timing of the circuit at higher engine speeds.

During operation at higher engine speeds (about 4,000-max RPM), capacitor 392 acts like a "short" and allows the half-wave rectified signal generated by trigger coil 32 to bypass timing capacitor 396 and timing switch 394. Thus, the trigger pulse is applied almost immediately to first switching device 370, which in turn causes ignition capacitor 360 to discharge earlier than when the engine is at lower speeds. For example, the particular timing circuit embodiment shown here produces an ignition timing of approximately 25° BTDC when the engine is being operated at or above about 4,000 RPM. 25° BTDC is, of course, a timing advance compared to the 10° BTDC produced at lower engine speeds. It should be recognized that the particular circuit arrangement, ignition timing values, engine speeds, etc. described above are only provided as an example and can easily differ from the exemplary embodiment previously explained. A further discussion of ignition timing circuits is included in U.S. Pat. No. 6,388,445, which is assigned to the assignee hereof and incorporated herein by reference.

While the embodiments explained above presently constitute the preferred embodiments, many others are also possible. In addition, while similar reference numerals have been used amongst several different embodiments, it is to be understood that various electrical components may have different values and arrangements within and between the several embodiments disclosed. It is understood that terms used herein are merely descriptive, rather than limiting, and that various changes may be made without departing from the spirit or scope of the invention as defined by the following claims.

Although not specifically shown in the drawings, it is possible to provide a control circuit that incorporates two or more of the features of the embodiments shown in FIGS. 2–5. For example, a single control circuit could include the additional charge coil 158 of FIG. 3, the speed limiting feature 258 of FIG. 4, and/or the ignition timing feature 358 of FIG. 5. Any combination of these features could be included into a single control circuit embodiment.

The invention claimed is:

1. A control circuit for use with an ignition system of an engine, comprising:

a charging circuit having a charge coil coupled to an ignition capacitor, at least some of the energy induced in said charge coil is stored on said ignition capacitor;

a timing circuit for generating a trigger signal and having a trigger coil coupled to a first switching device, said trigger signal is generated by said trigger coil and causes said first switching device to discharge said ignition capacitor; and a shutdown circuit for generating a shutdown signal and having a second switching device coupled to a kill-switch and a shutdown capacitor, said shutdown signal is generated by activation of said kill-switch and causes said second switching device to discharge said shutdown capacitor;

wherein discharge of said shutdown capacitor biases said first switching device such that it continues to discharge said ignition capacitor generally until the engine stops.

2. The control circuit of claim 1, wherein said charge coil provides energy to both said ignition capacitor and said shutdown capacitor.

3. The control circuit of claim 2, wherein said charging circuit further includes an additional current path for allowing energy not stored on said shutdown capacitor to charge said ignition capacitor.

4. The control circuit of claim 1, wherein activation of said kill-switch creates a current path through said trigger coil and said kill-switch that activates said second switching device.

5. The control circuit of claim 1, wherein said kill-switch is a positive-on/automatic-off type switch.

6. The control circuit of claim 1, wherein said shutdown capacitor forms part of an RC circuit having a time constant which prolongs the activation of said first switching device.

7. The control circuit of claim 6, wherein said charge coil provides energy to said shutdown capacitor which further prolongs the activation of said first switching device.

8. The control circuit of claim 1, wherein said charging circuit further includes an additional charge coil, said charge coil provides energy to said ignition capacitor and said additional charge coil provides energy to said shutdown capacitor.

9. The control circuit of claim 1, wherein said timing circuit further includes a speed limiting feature having an RC circuit coupled to said first switching device, when the engine is below a predetermined speed, said RC circuit generally does not affect the activation of said first switching device; and when the engine is above said predetermined speed, said RC circuit prolongs the activation of said first switching device following said trigger signal.

10. The control circuit of claim 1, wherein said timing circuit further includes an ignition timing feature having an RC circuit coupled to a voltage comparator and said first switching device; and when the engine is below a predetermined speed, said ignition timing feature retards the ignition timing compared to when the engine is above said predetermined speed.

11. The control circuit of claim 1, wherein discharge of said shutdown capacitor occurs within one flywheel revolution of activation of said kill-switch.

12. A control circuit for use with a capacitor discharge ignition system of an engine having an ignition capacitor, comprising:

a timing circuit having a first switching device;

a shutdown circuit having a second switching device, a kill-switch and a shutdown capacitor that is part of an RC circuit, said second switching device being coupled to said kill-switch, said shutdown capacitor and said first switching device; and wherein activation of said kill-switch causes: (i) said second switching device to discharge said shutdown capacitor, (ii) said discharged shutdown capacitor to activate said first switching device, (iii) said activated first switching device to discharge the ignition capacitor, and (iv) said RC circuit to prolong the activation of said first switching device.

13. The control circuit of claim 12, wherein said control circuit further includes a charging circuit having a charge coil coupled to an ignition capacitor.

14. The control circuit of claim 13, wherein said charge coil provides energy to said shutdown capacitor which further prolongs the activation of said first switching device.

15. The control circuit of claim 13, wherein said charge coil provides energy to both said ignition capacitor and said shutdown capacitor.

16. The control circuit of claim 14, wherein said charging circuit further includes an additional current path for allowing energy not stored on said shutdown capacitor to charge said ignition capacitor.

17. The control circuit of claim 13, wherein said charging circuit further includes an additional charge coil, said charge coil provides energy to said ignition capacitor and said additional charge coil provides energy to said shutdown capacitor.

18. The control circuit of claim 12, wherein said timing circuit further includes a trigger coil coupled to said first switching device, and activation of said kill-switch creates a current path through said trigger coil and said kill-switch that activates said second switching device.

19. The control circuit of claim 12, wherein said kill-switch is a positive-on/automatic-off type switch.

20. The control circuit of claim 12, wherein said timing circuit further includes a speed limiting feature having an RC circuit coupled to said first switching device, when the engine is below a predetermined speed, said RC circuit generally does not affect the activation of said first switching device; and when the engine is above said predetermined speed, said RC circuit prolongs the activation of said first switching device following a trigger signal.

21. The control circuit of claim 12, wherein said timing circuit further includes an ignition timing feature having an RC circuit coupled to a voltage comparator and said first switching device; and when the engine is below a predetermined speed, said ignition timing feature retards the ignition timing compared to when the engine is above said predetermined speed.

22. The control circuit of claim 12, wherein discharge of said shutdown capacitor occurs within one flywheel revolution of activation of said kill-switch.

23. A capacitor discharge ignition system for use with a light-duty combustion engine, comprising:

a flywheel having at least one magnetic element;

a stator assembly having a lambstack located proximate said flywheel;

an ignition coil having primary and secondary windings carried by said lambstack;

a spark plug coupled to said secondary winding;

a control circuit coupled to said primary winding and having a charging circuit, a timing circuit and a shutdown circuit;

said charging circuit includes a charge coil carried by said lambstack and coupled to an ignition capacitor, at least some of the energy induced in said charge coil is stored on said ignition capacitor;

said timing circuit generates a trigger signal and includes a trigger coil that is carried by said lambstack and is coupled to a first switching device, said trigger signal is generated by said trigger coil and causes said first switching device to discharge said ignition capacitor;

said shutdown circuit generates a shutdown signal and includes a second switching device coupled to a kill-switch and a shutdown capacitor, said shutdown signal is generated by activation of said kill-switch and causes said second switching device to discharge said shutdown capacitor; and wherein discharge of said shutdown capacitor biases said first switching device such that it continues to discharge said ignition capacitor.

24. A shutdown method for use with a spark ignition combustion engine, comprising the steps of:

(a) generating a shutdown signal in response to activation of a kill-switch;

(b) discharging a shutdown capacitor in response to said shutdown signal;

(c) discharging an ignition capacitor in response to said shutdown capacitor discharge, wherein said ignition capacitor discharge causes a final ignition pulse; and (d) utilizing an RC circuit to continue said ignition capacitor discharge until the combustion engine comes to a stop.

25. The method of claim 24, wherein steps (a), (b) and (c) occur within one flywheel revolution of said engine.

* * * * *